US006106354A

United States Patent [19]

Harry

[11] Patent Number: 6,106,354

[45] Date of Patent: Aug. 22, 2000

[54] OPERATOR-POWERED MODEL AIRCRAFT WITH REALISTIC SIMULATED ENGINE SOUNDS

[76] Inventor: Jesse F. Harry, 1210 S. Palmetto Ave., Sanford, Fla. 32771

[21] Appl. No.: 09/336,202

[22] Filed: Jun. 18, 1999

[51] Int. Cl.[7] ..... A63H 27/04; A63H 27/30

[52] U.S. Cl. ..... 446/30; 446/36

[58] Field of Search ..... 446/30, 34, 36, 446/57, 59, 61, 230, 232, 397, 404

[56] References Cited

U.S. PATENT DOCUMENTS

| | | | |
|---|---|---|---|
| 1,413,454 | 4/1922 | Calarco | 446/30 |
| 1,443,964 | 2/1923 | Nicholas et al. | 446/30 |
| 1,712,074 | 5/1929 | Fridolph | 446/30 |
| 3,537,208 | 11/1970 | Martin | 446/30 |

FOREIGN PATENT DOCUMENTS

| | | | |
|---|---|---|---|
| 1194630 | 11/1959 | France | 446/30 |
| 456144 | 2/1928 | Germany | 446/30 |
| 460365 | 1/1937 | United Kingdom | 446/30 |

*Primary Examiner*—John A. Ricci
*Attorney, Agent, or Firm*—Adams Law Firm, P.A.

[57] ABSTRACT

A propeller aircraft for being powered by an operator moving the aircraft in a circular flight path on a tether, and adapted for emitting simulated realistic propeller and engine noises during flight. The aircraft includes an elongate fuselage carrying aerodynamic flight surfaces and at least one propeller assembly. The propeller assembly comprises a propeller shaft and a propeller hub having at least two propeller blades carried by and extending radially-outwardly from the propeller hub. The hub includes a bore therethrough for rotatably-mounting the hub on the propeller shaft. The bore is sufficiently larger in diameter than the shaft to permit axially-oscillating, non-concentric rotating motion of the propeller hub on the propeller shaft responsive to and proportional to the rate of movement of the aircraft through the air on the tether by the operator. An impact surface proximate the propeller shaft is provided for being impacted responsive to rotation of the propeller hub. The impact surface has characteristics which, when impacted, cooperate with the propeller hub to create simulated realistic multi-frequency propeller and engine noises.

11 Claims, 9 Drawing Sheets

OPERATOR-POWERED MODEL AIRCRAFT WITH REALISTIC SIMULATED ENGINE SOUNDS

TECHNICAL FIELD AND BACKGROUND OF THE INVENTION

This invention relates to an operator-powered model aircraft with realistic simulated engine sounds. While the aircraft can be operated simply as an enjoyable recreation, the particular embodiment of the invention disclosed in this application is intended to aid in the training of student model airplane pilots as an introduction to principles of flight and as preparation for flying various types of powered model aircraft. Correct use of the aircraft according to this invention promotes control skills, techniques and safety procedures leading to responsible and productive powered model flying. The model aircraft according to the present invention facilitates enjoyment of the training exercise by providing the aircraft with very realistic simulated engine and propeller noises. The simulated engine noise is that of a full-size, reciprocating engine, propeller-driven aircraft, not of a model aircraft engine.

A reciprocating engine, propeller-driven aircraft, particularly high-powered military type aircraft, have a distinctive sound created by several engine components, such as turbochargers, exhaust manifolds, gearing and propeller pitch controls, operating at distinct frequencies and amplitudes, and with various overtones caused by resonance with other aircraft components, such as the cowling. Conventional operator-powered aircraft typically make little noise other than high-frequency, low amplitude noise of the aircraft fuselage, flight surfaces and propeller through the air. In contrast, the aircraft according to the present invention creates several distinct noise frequencies which interact to create a sound which realistically simulates the noise made by high-powered reciprocating engine, propeller-driven aircraft. These realistic engine sounds provide a more enjoyable and realistic learning experience for the student.

SUMMARY OF THE INVENTION

Therefore, it is an object of the invention to provide an operator-powered model aircraft having realistic simulated engine sounds.

It is another object of the invention to provide an operator-powered model aircraft which promotes enjoyable learning by student model airplane pilots.

It is another object of the invention to provide an operator-powered model aircraft which promotes development of skills, techniques and safety procedures useful in transitioning to flying powered model aircraft.

These and other objects of the present invention are achieved in the preferred embodiments disclosed below by providing a propeller aircraft for being powered by an operator moving the aircraft in a circular flight path on a tether, and adapted for emitting simulated realistic propeller and engine noises during flight. The aircraft includes an elongate fuselage carrying aerodynamic flight surfaces and at least one propeller assembly. The propeller assembly comprises a propeller shaft and a propeller hub having at least two airfoil propeller blades carried by and extending radially-outwardly from the propeller hub. The hub includes a bore therethrough for rotatably-mounting the hub on the propeller shaft. The bore is sufficiently larger in diameter than the shaft to permit axially-oscillating, non-concentric rotating motion of the propeller hub on the propeller shaft responsive to and proportional to the rate of movement of the aircraft through the air on the tether by the operator. An impact surface proximate the propeller shaft is provided for being impacted responsive to rotation of the propeller hub. The impact surface has characteristics which, when impacted, create simulated realistic multi-frequency propeller and engine noises.

According to one preferred embodiment of the invention, a washer is loosely positioned on the propeller shaft between the propeller hub and the impact surface for providing additional noise-creating surfaces.

According to another preferred embodiment of the invention, one of the propeller blades has an airfoil surface having a larger area than another of the propeller blades for introducing eccentric rotation to the propeller hub.

According to yet another preferred embodiment of the invention, the propeller shaft is stationary.

According to yet another preferred embodiment of the invention, the aircraft has a single propeller assembly positioned on a forward end of the fuselage.

Preferably, the forward end of the fuselage is configured to represent an engine cowling with the propeller shaft extending forwardly of the cowling with the propeller hub mounted thereon.

According to yet another preferred embodiment of the invention, the aircraft is a low-wing monoplane.

According to yet another preferred embodiment of the invention, the propeller hub has a through bore therein for receiving the propeller shaft, the bore being larger in diameter than the diameter of the propeller shaft to facilitate rotation of the propeller hub, the bore having a circular portion in the forward end of the propeller hub and an enlarged, oval portion in the aft end of the propeller hub for facilitating eccentric, vibrating rotation of the propeller hub.

According to yet another preferred embodiment of the invention, the propeller blades have truncated end portions.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
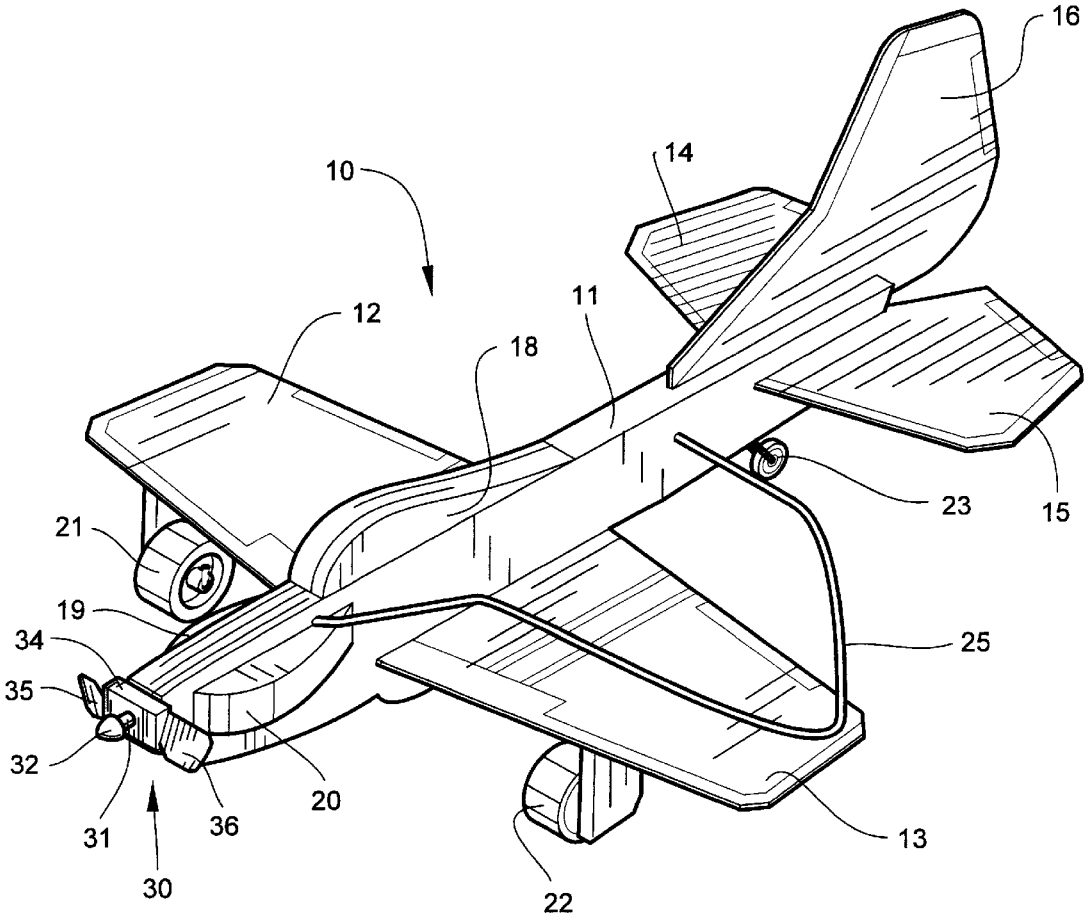
FIG. 1 is a perspective view from the front of an operator-powered model aircraft according to a preferred embodiment of the invention.
Figure 2:
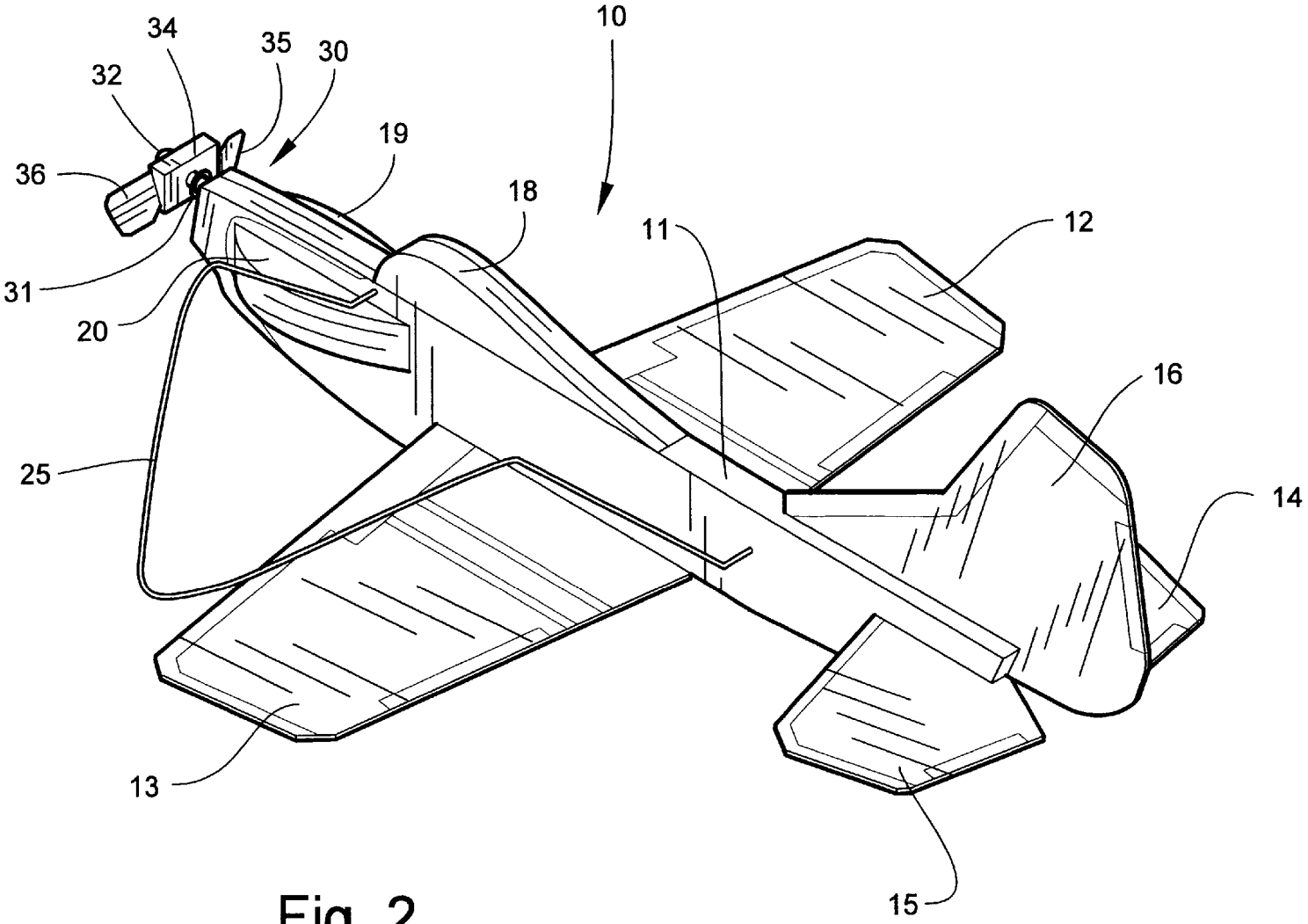
FIG. 2 is a perspective view from the rear of the operator-powered model aircraft shown in FIG. 1.
Figure 3:
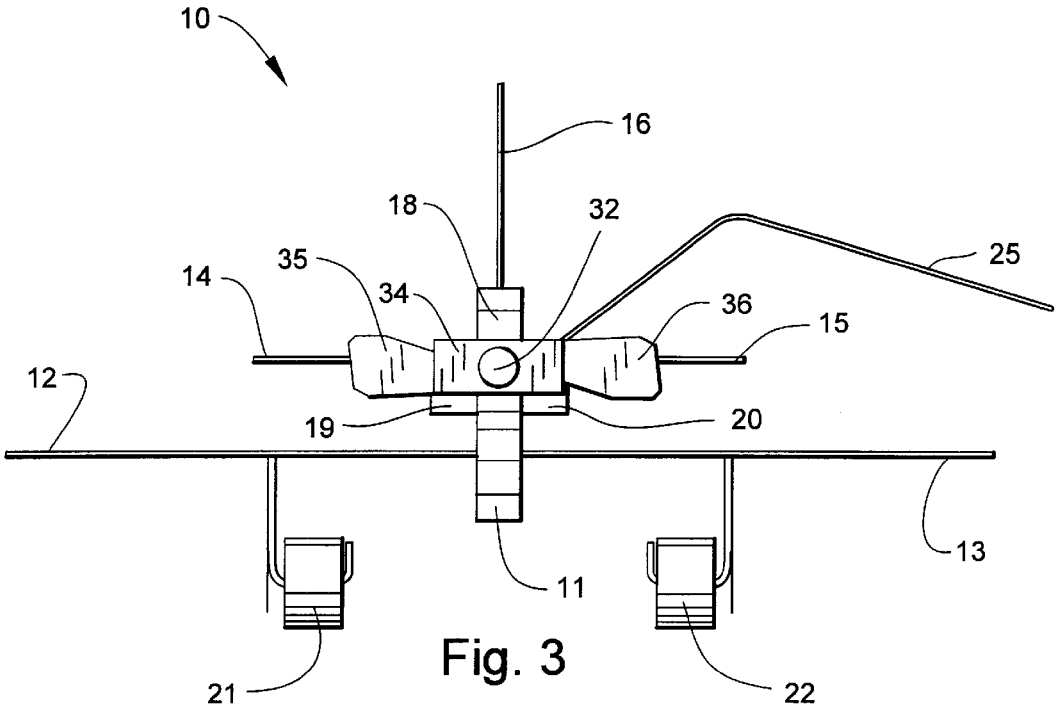
FIG. 3 is a is a front elevation of the aircraft shown in FIG. 1.
Figure 4:
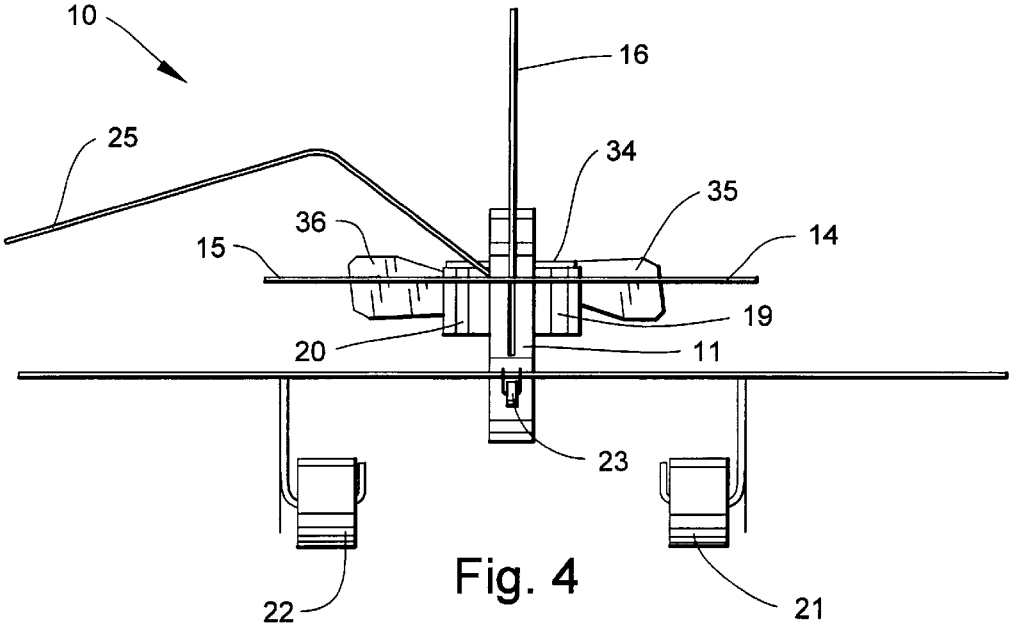
FIG. 4 is a rear elevation of the aircraft shown in FIG. 1.
Figure 5:
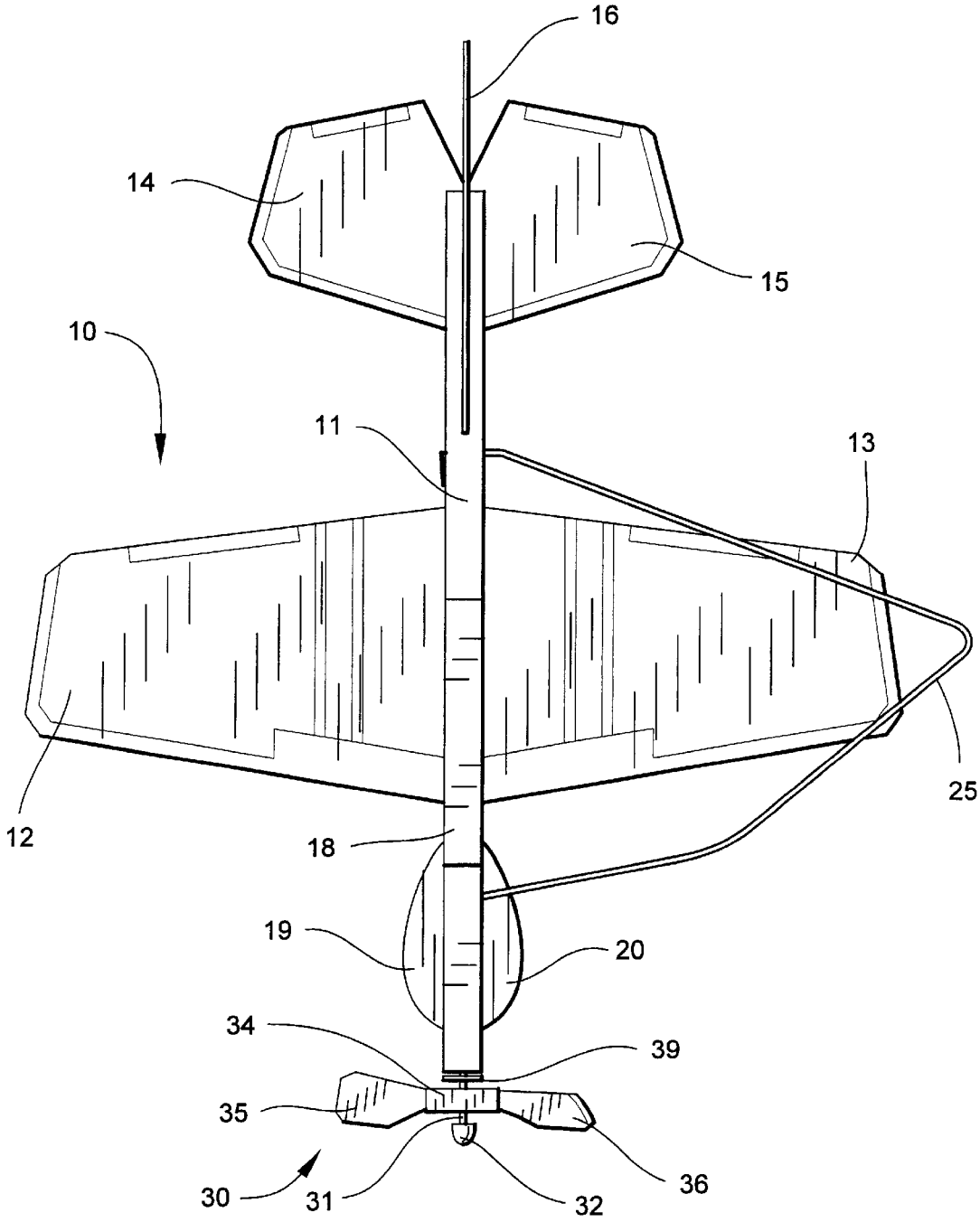
FIG. 5 is a top plan view of the aircraft shown in FIG. 1.
Figure 6:
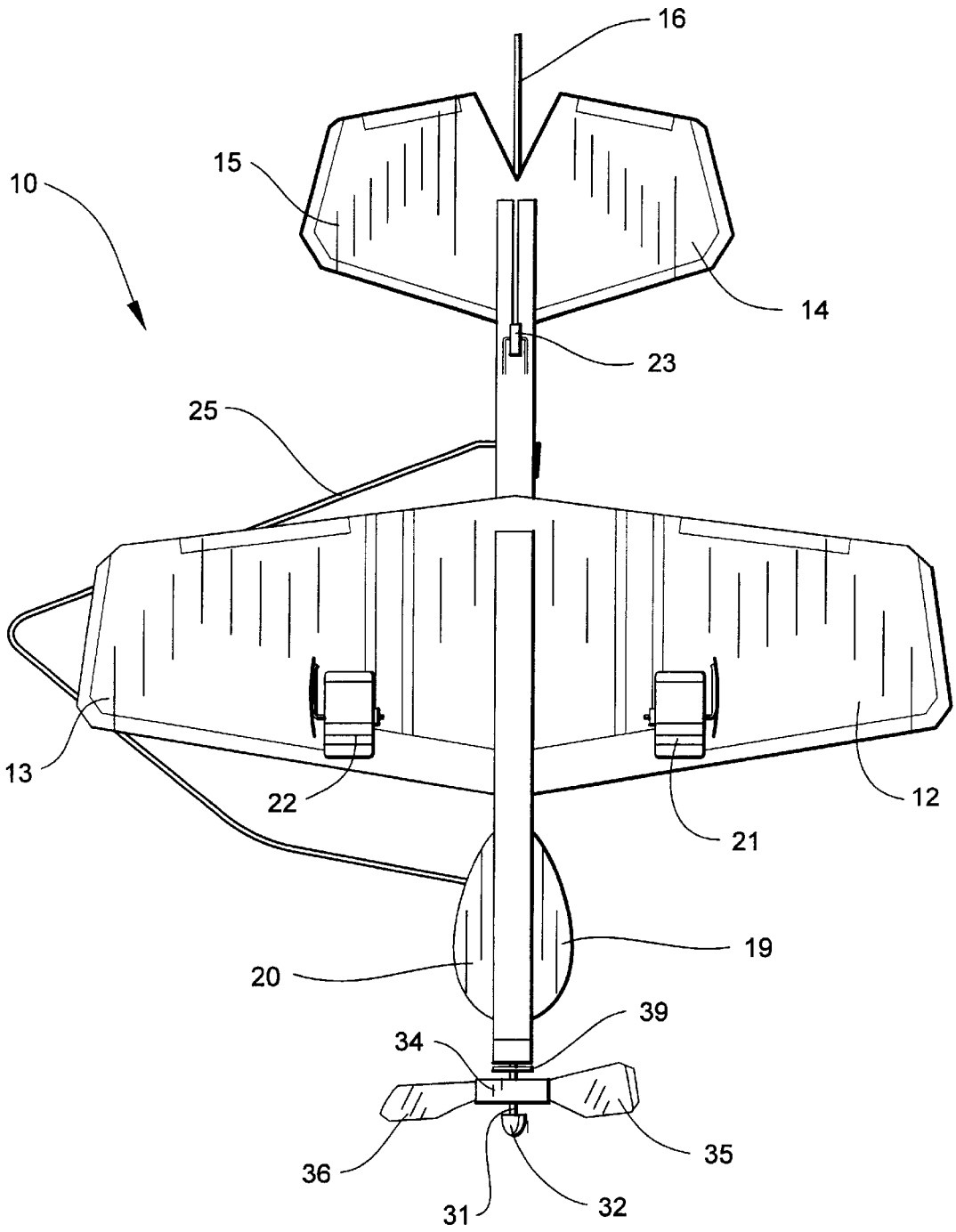
FIG. 6 is a bottom plan view of the aircraft shown in FIG. 1.
Figure 7:
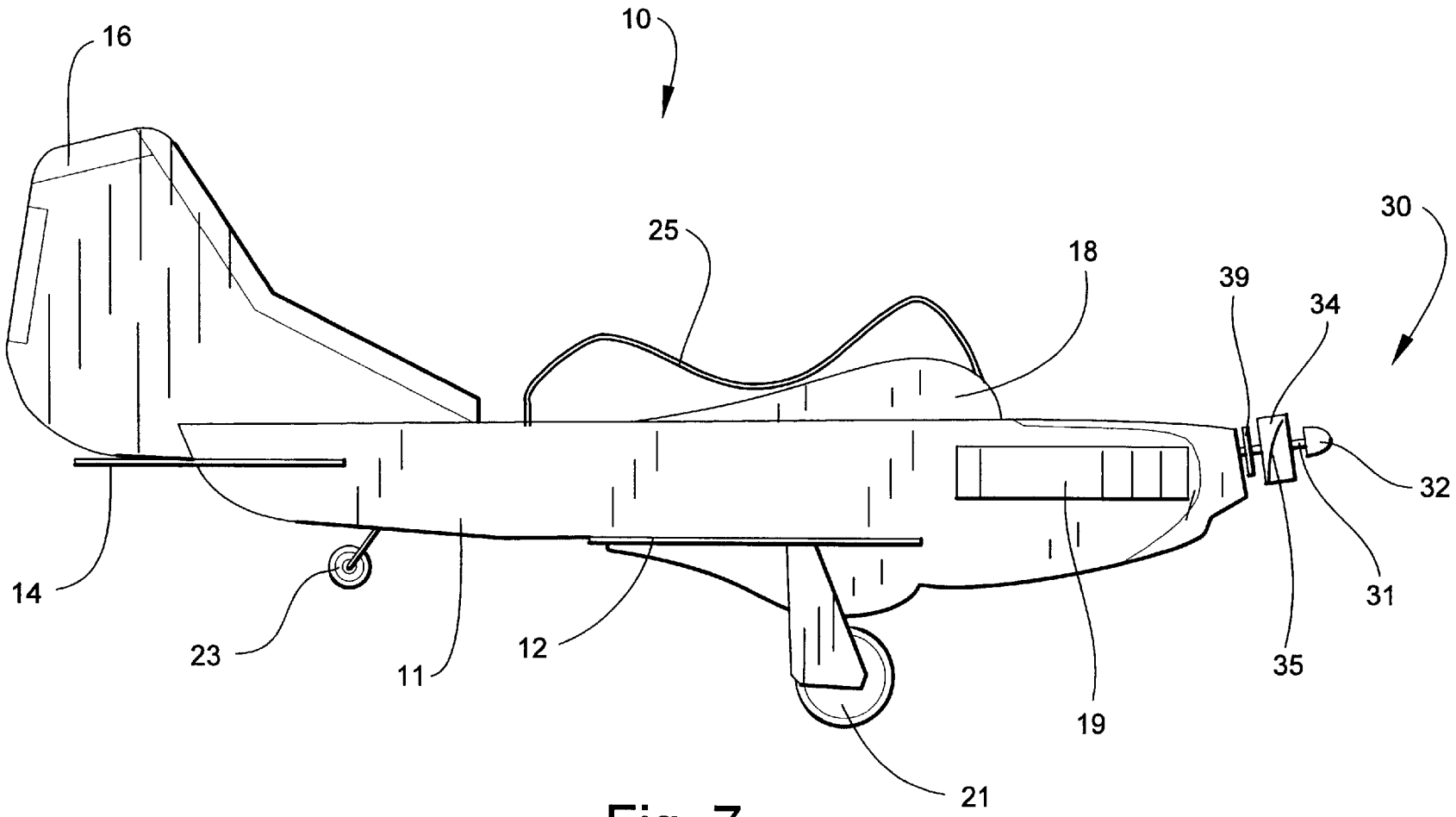
FIG. 7 is a side elevation of the starboard side of the aircraft shown in FIG. 1.
Figure 8:
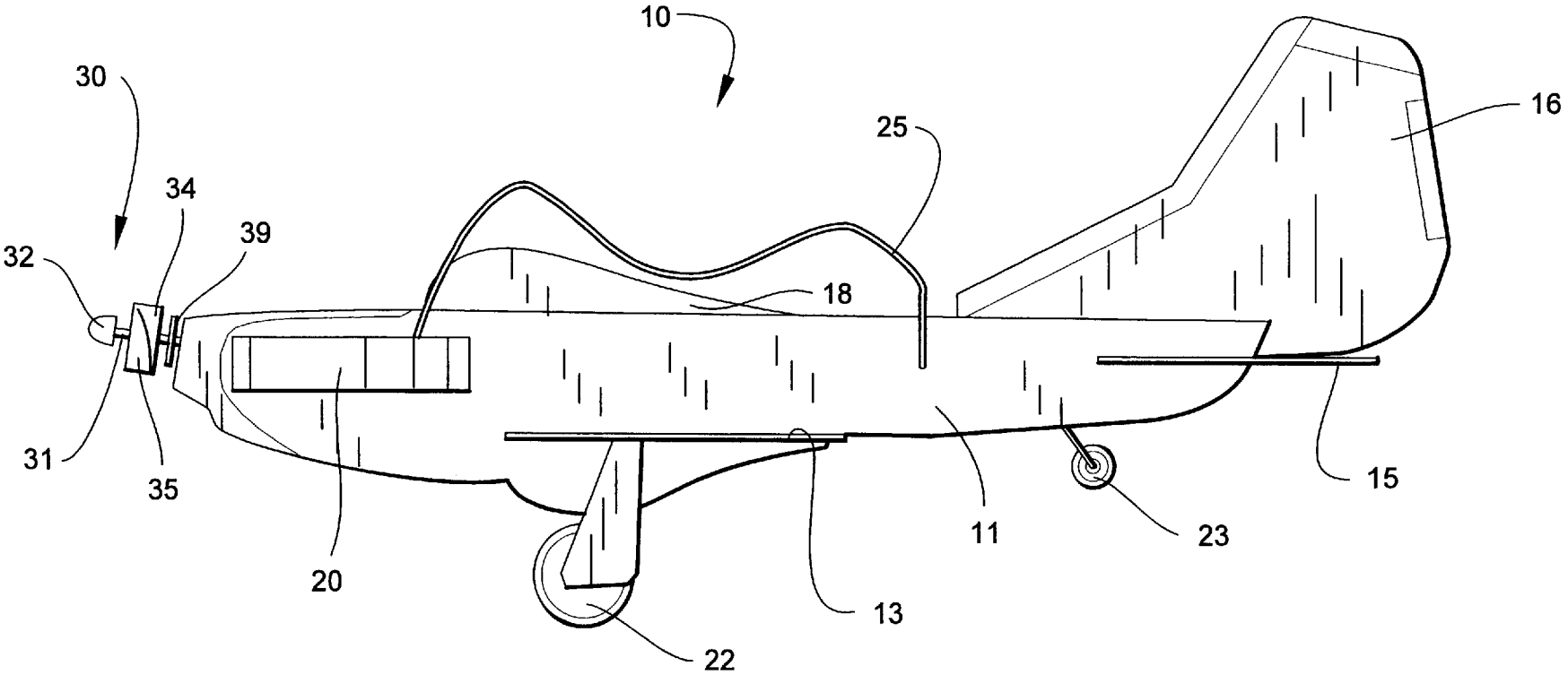
FIG. 8 is a side elevation of the port side of the aircraft shown in FIG. 1.

Referring now specifically to the drawings, an operator-powered model aircraft according to the present invention is illustrated in FIGS. 1–8 and shown generally at reference numeral 10. The particular preferred embodiment of the model aircraft 10 according to the invention is a tail wheel, single-engine, propeller-driven,low-wing monoplane. The aircraft 10 includes a fuselage 11 and attached flight surfaces, including wings 12 and 13, horizontal stabilizers 14 and 15, and a vertical stabilizer 16. These flight surfaces are shaped to be aerodynamic and provide stable flight of the aircraft 10 as is it flown by the operator. A cockpit 18 is positioned on top of the fuselage 11, and outwardly-extending curved cowling structures 19 and 20 enhance the realism of the aircraft 10. The aircraft 10 is supported by main landing gear wheels 21 and 22 and a tail wheel 23. Preferably, the aircraft 10 is formed of lightweight wood, such as balsa wood, and metal, such as aluminum. A variety of materials, including woods, such as poplar and white pine, metals, plastics, card stock, and resin composites may be suitable. The selection of materials for construction of the fuselage 11 and attached flight surfaces is within the skill of the model aircraft designer.

The aircraft 10 is intended to be powered by an operator, who holds one end of a tether, the other end of which is attached to the aircraft 10. The operator either rotates his body or twirls the tether over his head, causing the aircraft to fly in a circular pattern around the operator. With skill and practice, the aircraft 10 may climb and dive, and be landed on a smooth surface. A wire frame 25 mounted to the fuselage 11 serves as a connection point for the tether.

A propeller assembly 30 is mounted on the forward end, or nose, of the fuselage 11.

Figure 9:
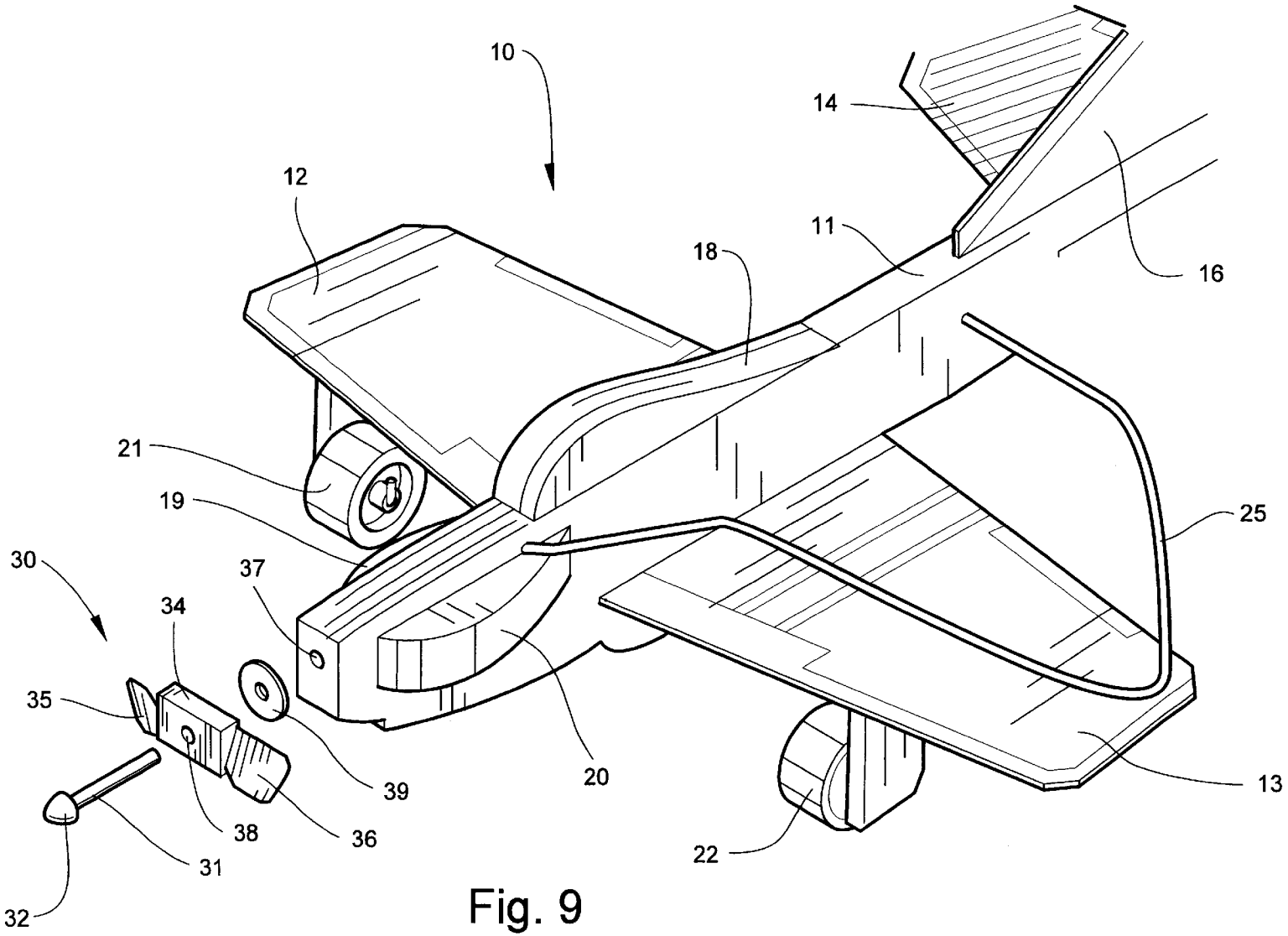
FIG. 9 is a partially-exploded perspective view showing details of the propeller assembly.

Referring now to FIG. 9, the propeller assembly 30 is comprised of a stationary propeller shaft 31 with an enlarged head 32 simulating a spinner on one end which is preferably made of a relatively soft, durable material such as a hard foam R-12 insulation material. A propeller hub 34 carrying two propeller blades 3 5 and 36 thereon is positioned on the propeller shaft 31 by means of a through bore 38. The blades 35 and 36 are mounted on the hub 34 at reciprocal aerodynamic diagonal angles for creating torque sufficient to rotate the propeller hub 34 on shaft 31 as the aircraft 10 is powered through the air by the operator. The blades 35 and 36 themselves preferably have an aerodynamic curve. The blades 35 and 36 also have beveled leading edges 35A, 36A, respectively. See FIG. 3. A washer 39 is fitted onto the propeller shaft 31 between the propeller hub 34 and the forward end of the fuselage 11. The propeller shaft 31, with the propeller hub 34 and washer 39 positioned thereon, is securely and stationarily positioned in a mounting hole 37 in the forward end of the fuselage 11. The forward end of the fuselage 11 forms an impact surface which the washer 39 contacts as the hub 34 rotates. The propeller may also have 3 or 4 propeller blades.

The components of the propeller assembly 30 are designed to cooperate in such a way as to create noise-creating eccentric vibrations and oscillations as the aircraft 10 is powered through the air, as follows:

Blades

The propeller blades 35 and 36 are formed of thin aluminum sheet material preferably the thickness of a conventional aluminum soft drink can. The propeller blades 35 and 36 are slightly different in length and width in order to create an unbalanced and thus eccentric rotation. The beveled edges 35A and 36A are preferably the leading edges of the propellers 35 and 36 and thus create significant noise as they slice into the moving airstream. The trailing edges of the propellers 35, 36 are generally in alignment with the rear of the hub 34. One of the blades 35, 36 is placed on a different diagonal than the other blade relative to the hub 34. Both blades are preferably slightly wider at their widest point than the depth of the propeller hub 34. Each of these features creates and intensifies the eccentric rotation of the propeller hub 34, and creates within the overall eccentric rotation secondary eccentricities. Alternatively, the beveled edges 35A, 36A of the propeller 35, 36 may be used as the trailing edges, and the blade itself may be flat.

Propeller Hub

Figure 10:
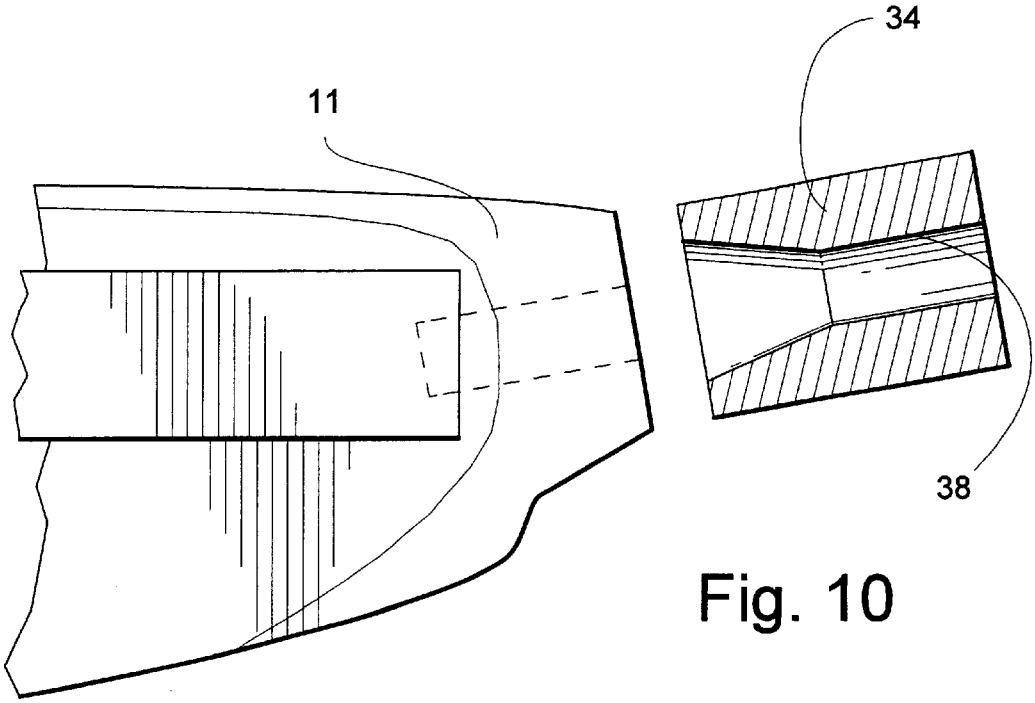
FIG. 10 is a vertical cross-sectional view of the propeller hub according to an embodiment of the invention.
Figure 11:
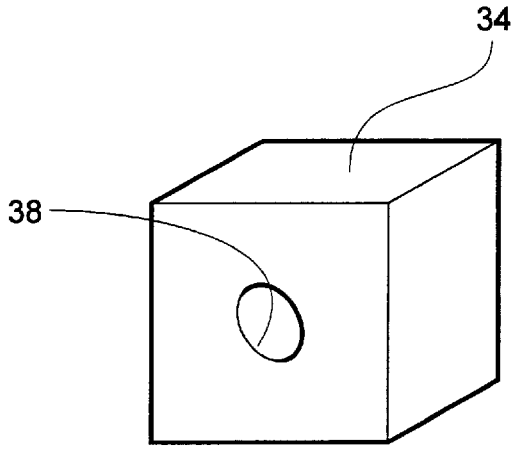
FIG. 11 is a perspective view of the front of the propeller hub shown in FIG. 10.
Figure 12:
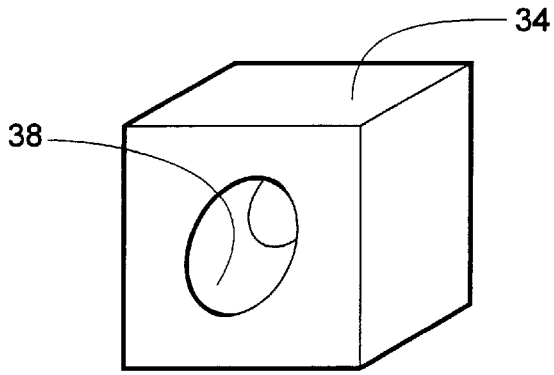
FIG. 12 is a perspective view of the rear of the propeller hub shown in FIG. 10.

The eccentric rotation created by the propellers 35 and 36 is converted to noise-creating vibration by the rotation of the propeller hub 34 on the diameter propeller shaft 31. To accomplish this vibration, the bore 38 in the propeller hub 34 is larger in diameter than the diameter of the propeller shaft 31, and is eccentrically-shaped to facilitate unrestricted eccentric rotation of the propeller hub 34. As is shown in FIG. 10, the forward portion of the bore 38 is smaller in diameter than the rearward portion. As is shown in FIG. 11, the forward portion of the bore 38 is preferably circular, while the rearward portion of the bore 38 is oval, and the long axis of the oval is between the vertical and horizontal axis of the propeller hub 34. The particular type of material from which the propeller hub 34 is formed is a factor in the resonance of the sound created by the propeller assembly 30. A light-weight but dense wood such as pine is suitable.

Propeller Shaft

The propeller shaft 31 is preferably a nail, such as a 16 penny nail. The shaft 31 is ground smooth in the area on which the propeller hub 34 will rotate. The propeller shaft 31 is preferably mounted at a slight nose-high angle to the horizontal (see FIG. 7) and is slightly offset to the starboard as the aircraft 10 is faced from the front. This introduces yet another element of eccentricity into the propeller assembly 30.

Washer

The washer 39, for example, a No. 10 SAE flat washer rotates freely on the propeller shaft 31. In the preferred example described in this application the hole size of a No 10 washer is sufficiently larger in diameter than the diameter of the 16 penny nail from which the propeller shaft 31 is formed so as to permit the washer 39 to wobble eccentrically on the propeller shaft 31 in response to the eccentric rotation of the propeller hub 34. The washer 39 provides additional impact surfaces which the propeller hub 34 and the nose of the fuselage 11 engage.

EXAMPLE

In accordance with the discussion above, an example of an aircraft 10 which creates very realistic simulated engine sounds is set out below:

| | |
|---|---|
| Overall length of aircraft: | 12.5" |
| Wingspan: | 10.50" |
| Height of vertical stabilizer: | 2.75" |
| Propeller Hub 34 | |
| Depth | 5/16" |
| Width | 3/8" |
| Length | 1 1/16" |
| Bore diameter (forward portion) | 7/32" |
| Bore size (rearward portion) | 1/4" by 4/8" |
| Propeller 35 | |
| Length | 13/16" |
| Width | 7/8" |
| Propeller 36 | |
| Length | 7/8" |
| Width | 3/4" |
| Propeller Shaft 31 | 16 Penny Nail |
| Washer 39 | No. 10 SAE |
| Materials | |
| Fuselage 11 | Balsa wood |
| Propellers 35, 36 | Soft drink can-thickness aluminum sheet |
| Propeller Hub 34 | Wood |
| Flight Surfaces | Coated card stock |
| Wheels | Plastic |

The above example is intended only to illustrate one embodiment of the invention. Aircraft having the noise-creating propeller assembly can vary widely in construction materials, size, configuration and appearance, and number of propeller assemblies. Designs can include features such as bi-wing, high wing, stagger-wing configurations as well as experimental and unconventional designs.

An operator-powered model aircraft with realistic simulate sounds is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A propeller aircraft for being powered by an operator moving the aircraft in a circular flight path on a tether, and adapted for emitting simulated realistic propeller and engine noises during flight, said aircraft including an elongate fuselage carrying aerodynamic flight surfaces and at least one propeller assembly, said propeller assembly comprising:

(a) a propeller shaft;

(b) a propeller hub having at least two airfoil propeller blades carried by and extending radially-outwardly from said propeller hub, wherein at least one of the propeller blades has an airfoil surface having an area larger than another of the propeller blades for introducing eccentric rotation to the propeller hub;

(c) said hub including a bore therethrough for rotatably-mounting said hub on said propeller shaft, the bore being sufficiently larger in diameter than the shaft to permit axially-oscillating, non-concentric rotating motion of the propeller hub on the propeller shaft responsive to and proportional to the rate of movement of the aircraft through the air on the tether by the operator; and (d) an impact surface proximate the propeller shaft for being impacted responsive to rotation of the propeller hub, said impact surface having characteristics which, when impacted, cooperate with the propeller hub to create simulated realistic multi-frequency propeller and engine noises.

2. A propeller aircraft according to claim 1, and including a washer loosely positioned on said propeller shaft between the propeller hub and the impact surface for providing additional noise-creating surfaces.

3. A propeller aircraft according to claim 1, wherein said propeller shaft is mounted at a nose-high angle to the horizontal.

4. A propeller aircraft according to claim 1, wherein said aircraft has a single propeller assembly positioned on a forward end of the fuselage.

5. A propeller aircraft according to claim 4, wherein the forward end of the fuselage is configured to represent an engine cowling with the propeller shaft extending forwardly of the cowling with the propeller hub mounted thereon.

6. A propeller aircraft according to claim 1, wherein said aircraft is a low-wing monoplane.

7. A propeller aircraft according to claim 1, wherein said propeller hub has a through bore therein for receiving the propeller shaft, said bore being larger in diameter than the diameter of the propeller shaft to facilitate rotation of the propeller hub, the bore having a circular portion in the forward end of the propeller hub and an enlarged, oval portion in the aft end of the propeller hub for facilitating eccentric, vibrating rotation of the propeller hub.

8. A propeller aircraft according to claim 1, wherein said propeller blades have truncated end portions.

9. A propeller aircraft for being powered by an operator moving the aircraft in a circular flight path on a tether, and adapted for emitting simulated realistic propeller and engine noises during flight, said aircraft including an elongate fuselage carrying aerodynamic flight surfaces and at least one propeller assembly, said propeller assembly comprising:

(a) a propeller shaft;

(b) a propeller hub having at least two airfoil propeller blades carried by and extending radially-outwardly from said propeller hub;

(c) said propeller hub including a bore therethrough for rotatably-mounting said propeller hub on said propeller shaft, the bore being sufficiently larger in diameter than the propeller shaft to permit axially-oscillating, non-concentric rotating motion of the propeller hub on the propeller shaft responsive to and proportional to the rate of movement of the aircraft through the air on the tether by the operator, and the bore further having a circular portion in the forward end of the propeller hub and an enlarged, oval portion in the aft end of the propeller hub for facilitating eccentric, vibrating rotation of the propeller hub; and (d) an impact surface proximate the propeller shaft for being impacted responsive to rotation of the propeller hub, said impact surface having characteristics which, when impacted, cooperate with the propeller hub to create simulated realistic multi-frequency propeller and engine noises.

10. A propeller aircraft for being powered by an operator moving the aircraft in a circular flight path on a tether, and adapted for emitting simulated realistic propeller and engine noises during flight, said aircraft including an elongate fuselage carrying aerodynamic flight surfaces and at least one propeller assembly, said propeller assembly comprising:

(a) a propeller shaft;

(b) a propeller hub having at least two airfoil propeller blades carried by and extending radially-outwardly from said propeller hub wherein at least one of the propeller blades has an airfoil surface having an area larger than another of the propeller blades for introducing eccentric rotation to the propeller hub; and (c) said hub including a bore therethrough for rotatably-mounting said hub on said propeller shaft, the bore being sufficiently larger in diameter than the shaft to permit axially-oscillating, non-concentric rotating motion of the propeller hub on the propeller shaft responsive to and proportional to the rate of movement of the aircraft through the air on the tether by the operator.

11. A propeller aircraft according to claim 10, wherein said propeller shaft is mounted at a nose-high angle to the horizontal.

* * * * *